US012595975B2

(12) United States Patent
Park et al.

(10) Patent No.: US 12,595,975 B2
(45) Date of Patent: Apr. 7, 2026

(54) HEAT EXCHANGER

(71) Applicant: LG ELECTRONICS INC., Seoul (KR)

(72) Inventors: Minjae Park, Seoul (KR); Sungsub Lee, Seoul (KR); Minsu Park, Seoul (KR); Hyungbum Kim, Seoul (KR); Juhyok Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 122 days.

(21) Appl. No.: 18/430,220

(22) Filed: Feb. 1, 2024

(65) Prior Publication Data

US 2024/0255231 A1 Aug. 1, 2024

(30) Foreign Application Priority Data

Feb. 1, 2023 (KR) ..... 10-2023-0013716

(51) Int. Cl.
*F28D 15/00* (2006.01)
*F25B 41/40* (2021.01)
*F28F 1/32* (2006.01)

(52) U.S. Cl.
CPC ..... *F28F 1/32* (2013.01); *F25B 41/40* (2021.01)

(58) Field of Classification Search
CPC ..... F28F 1/32; F25B 41/40
USPC ..... 165/104.19
See application file for complete search history.

(56) References Cited

U.S. PATENT DOCUMENTS

2005/0061494 A1* 3/2005 Tsuji ..... B21D 39/06 165/173
2013/0327512 A1 12/2013 Brotz et al.
2019/0382873 A1 12/2019 Ito

FOREIGN PATENT DOCUMENTS

DE 20 2017 104 743 U1 12/2017
DE 20 2017 102 436 U1 1/2018
IT 1105435 B * 11/1985
KR 10-2004-0053551 A 6/2004

* cited by examiner

*Primary Examiner* — Davis D Hwu
(74) *Attorney, Agent, or Firm* — Birch, Stewart, Kolasch & Birch, LLP

(57) ABSTRACT

A heat exchanger includes a plurality of refrigerant tubes configured to allow a refrigerant to flow, and a fin disposed between the adjacent refrigerant tubes, the fin being configured to transfer heat, the fin includes a plurality of first bodies, a plurality of second bodies, each second body being arranged between adjacent first bodies, a plurality of upper bodies, each upper body connecting an upper end of each first body and an upper end of each second body adjacent to each other, and a plurality of lower bodies, each lower body connecting a lower end of each first body and a lower end of each second body adjacent to each other, wherein a distance between each first body and each second body connected to both ends of one lower body of the plurality of lower bodies decreases as it approaches one upper body of the plurality of upper bodies.

18 Claims, 12 Drawing Sheets

HEAT EXCHANGER

CROSS-REFERENCE TO RELATED APPLICATION

The present application claims priority under 35 U.S.C. 119 to Korean Patent Application No. 10-2023-0013716, filed on Feb. 1, 2023, which is hereby incorporated by reference in its entirety.

BACKGROUND

Field

The present disclosure relates to a heat exchanger that suppresses inflow of water from an outside and improves drain performance.

Related Art

FIG. 19 is a perspective view briefly illustrating an external appearance of a heat exchanger according to the related art, FIG. 20 is an exploded view illustrating a coupling relationship of components of the heat exchanger according to the related art, and FIG. 21 is a view illustrating a cross section of a tube in FIG. 20.

Referring to these drawings, a conventional heat exchanger includes an upper header 2 located to correspond to an upper portion of a lower header 1, a plurality of tubes 3 located between the upper header 2 and the lower header 1, and a fin 6 located between the tubes 3. The lower header 1 is formed in a cylindrical shape and has a hollow inside, and a plurality of header holes 4 into which the tubes 3 are inserted and fixed are formed on one side of an outer periphery forming the external appearance of the lower header at equal intervals along a longitudinal direction of the lower header 1.

Here, the upper header 2 located at the upper portion corresponding to the lower header 1 has the same shape as the lower header 1. Both end portions of the tube 3 in the longitudinal direction are fixed to the header holes 4, and thus, the tubes 3 are arranged in parallel in longitudinal directions of the headers 1 and 2.

Meanwhile, the flowing air flows between each tube 3 and the two headers 1 and 2 by flowing to have a certain inclination toward the plane connecting the two headers 1 and 2 in the longitudinal direction. The tube 3 has a length that is a distance between both end portions fixed to the two headers 1 and 2, a thickness that is a distance perpendicular to a direction of the flowing air, and a width that is a distance parallel to the flow direction of the flowing air. The tube 3 has a rectangular plate shape having a width and a thin thickness that can be accommodated in the two headers 1 and 2, and a plurality of hollow channels 5 are formed inside the tube 3.

Each fin 6 is a plate shape having a thin thickness and is bent several times zigzag and installed between each tube 3. The fin 6 may have various shapes and may be fixed, but it is generally preferable to form a space so that flow resistance of flowing air is minimized.

The space between the fins 6 is generally very small, and air can flow in the space, but when external water is introduced into the space, there is a problem that the water between the fins cannot be drained to the outside of the fins due to the surface tension and viscosity of water.

In particular, when the heat exchanger is exposed to the external environment, rain easily flows into the space between each fin 6, cannot escape from the space between the fins 6, and thus, there is a problem that the fins 6 are corroded.

When each fin 6 is corroded, performance of the heat exchanger deteriorates and there is a problem that the refrigerant may leak.

RELATED ART LITERATURE

Patent Literature

Patent Document 1: Korean Laid-Open Patent Publication No. 20040053551

SUMMARY

An object of the present disclosure is to provide a heat exchanger that prevents corrosion of fins and tubes due to water.

Another object of the present disclosure is to provide a heat exchanger that prevents external water from entering a space between fins.

Still another object of the present disclosure is to provide a heat exchanger in which water in a space between fins is easily discharged to the outside.

Objects of the present disclosure are not limited to the object mentioned above, and other objects not mentioned will be clearly understood by those skilled in the art from the description below.

The heat exchanger according to the present disclosure is characterized in that fins located between refrigerant tubes include a plurality of bodies, and the bodies are disposed not parallel to each other.

According to an aspect of the present disclosure, there is provided a heat exchanger including: a plurality of refrigerant tubes through which refrigerant flows; and a fin disposed between the refrigerant tubes adjacent to each other to transfer heat, in which the fin includes a plurality of first bodies, a plurality of second bodies located between the plurality of first bodies, a plurality of upper bodies connecting an upper end of the first body and an upper end of the second body adjacent to each other, and a plurality of lower bodies connecting a lower end of the first body and a lower end of the second body adjacent to each other, and a distance between the first body and the second body connected to both ends of the lower bodies decreases as it approaches the upper body.

A distance between the first body and the second body connected to both ends of the upper bodies may decrease as it approaches the lower body.

Each first body may have a first inclination angle in a vertical direction, and each second body may have a second inclination angle in the vertical direction.

The first inclination angle and the second inclination angle may have the same angle as each other and may be inclined in directions opposite to each other.

The distance between the first body and the second body connected to both ends of the upper bodies may decrease as it approaches the lower body, and may become 0 at the same height as the lower body.

The distance between the first body and the second body connected to both ends of the lower bodies may be 0 at the same height as the upper body.

A portion where the upper body is connected to the first body and the second body may be rounded.

A portion where the lower body is connected to the first body and the second body may be rounded.

The upper body may be connected to a lower end of the refrigerant tube located at an upper portion of the refrigerant tubes adjacent to each other, and the lower body may be connected to an upper end of a refrigerant tube located at an upper portion of refrigerant tubes adjacent to each other.

A portion of the upper body may be located not to overlap the lower body in a vertical direction.

The fin is located to completely overlap the refrigerant tubes in a first direction.

The fin may include an inner portion located to overlap the refrigerant tubes in a first direction, and an outer portion not located to overlap the refrigerant tubes in the first direction.

The fin may further include a body opening portion passing through at least a portion of the lower body located in the outer portion.

The fin may further include a drain groove formed in the first body and the second body located in the outer portion to prevent inflow of water from an outside.

The plurality of refrigerant tubes may be located to overlap each other in an up-down direction, and the drain groove may be open downward.

The fin further may include an inflow prevention hole formed in the first body and the second body located in the outer portion to prevent the inflow of water from the outside.

The inflow prevention hole may be located above the drain groove.

The drainage groove may include a first inclined surface inclined in the first direction, and a second inclined surface inclined in the first direction and connected to one end of the first inclined surface.

According to another aspect of the present disclosure, there is provided a heat exchanger including: a plurality of refrigerant tubes through which refrigerant flows; and a fin disposed between the refrigerant tubes adjacent to each other to transfer heat, in which the fin includes a plurality of first bodies, a plurality of second bodies located between the plurality of first bodies, a plurality of upper bodies connecting an upper end of the first body and an upper end of the second body adjacent to each other, and a plurality of lower bodies connecting a lower end of the first body and a lower end of the second body adjacent to each other, and a distance between the lower end of the first body and the lower end of the second body connected to both ends of the lower bodies is larger than a distance between the upper end of the first body and the upper end of the second body connected to both ends of the lower bodies.

According to still another aspect of the present disclosure, there is provided a heat exchanger including: a plurality of refrigerant tubes through which refrigerant flows; and a fin disposed between the refrigerant tubes adjacent to each other to transfer heat, in which the fin includes an inner portion located to overlap the refrigerant tubes in a first direction, an outer portion not located to overlap the refrigerant tubes in the first direction, and a drain groove formed in the outer portion to prevent inflow of water from an outside.

DESCRIPTION OF EXEMPLARY EMBODIMENTS

Figure 1:
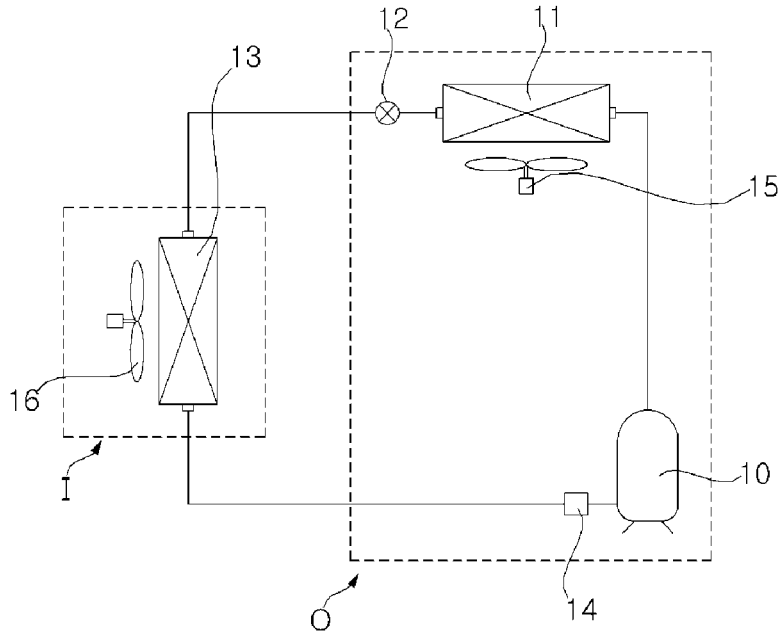
FIG. 1 is a diagram illustrating a refrigeration cycle device according to one embodiment of the present disclosure.

Advantages and features of the present disclosure and methods for achieving those of the present disclosure will become apparent upon referring to embodiments described later in detail with reference to the attached drawings. However, embodiments are not limited to the embodiments disclosed hereinafter and may be embodied in different ways. The embodiments are provided for perfection of disclosure and for informing persons skilled in this field of art of the scope of the present disclosure. The same reference numerals may refer to the same elements throughout the specification.

Spatially-relative terms such as "below", "beneath", "lower", "above", or "upper" may be used herein to describe one element's relationship to another element as illustrated in the Figures. It will be understood that spatially-relative terms are intended to encompass different orientations of the device in addition to the orientation depicted in the Figures. For example, if the device in one of the figures is turned over, elements described as "below" or "beneath" other elements would then be oriented "above" the other elements. The exemplary terms "below" or "beneath" can, therefore, encompass both an orientation of above and below. Since the device may be oriented in another direction, the spatially-relative terms may be interpreted in accordance with the orientation of the device.

The terminology used in the present disclosure is for the purpose of describing particular embodiments only and is not intended to limit the disclosure. As used in the disclosure and the appended claims, the singular forms "a", "an" and "the" are intended to include the plural forms as well, unless context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

In the drawings, the thickness or size of each layer is exaggerated, omitted, or schematically illustrated for convenience of description and clarity. Also, the size or area of each constituent element does not entirely reflect the actual size thereof.

Hereinafter, exemplary embodiments of the present disclosure will be described with reference to the accompanying drawings.

Figure 2:
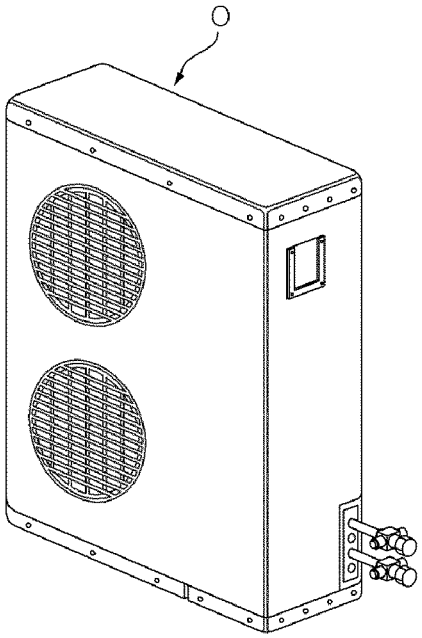
FIG. 2 is a perspective view illustrating an outside of an outdoor unit illustrated in FIG. 1.

FIG. 1 is a diagram illustrating a refrigeration cycle device according to one embodiment of the present disclosure, and FIG. 2 is a perspective view illustrating an outside of an outdoor unit illustrated in FIG. 1.

Referring to FIGS. 1 and 2, the refrigerating cycle device according to the present embodiment includes a compressor 10 for compressing refrigerant, an outdoor heat exchanger 11 for performing heat exchange between outdoor air and the refrigerant, an expansion mechanism 12 for expanding the refrigerant, and an indoor heat exchanger 13 for performing heat exchange between the refrigerant and indoor air.

The refrigerant compressed in the compressor 10 may be condensed through heat exchange with outdoor air while passing through the outdoor heat exchanger 11.

The outdoor heat exchanger 11 may be used as a condenser.

The refrigerant condensed by the outdoor heat exchanger 11 may be expanded by flowing into the expansion mechanism 12. The refrigerant expanded by the expansion mechanism 12 may be evaporated through heat exchange with indoor air while passing through the indoor heat exchanger 13.

The indoor heat exchanger 12 may be used as an evaporator for evaporating the refrigerant. The refrigerant evaporated by the indoor heat exchanger 12 may be recovered to the compressor 10.

The heat exchanger may include the indoor heat exchanger 12 and the outdoor heat exchanger 11.

The refrigerant circulates through the compressor 10, the outdoor heat exchanger 11, the expansion mechanism 12, and the indoor heat exchanger 13 and operates in a refrigeration cycle.

A suction channel of the compressor 10 may be connected to the compressor 10 to guide the refrigerant passing through the indoor heat exchanger 13 to the compressor 10. An accumulator 14 in which liquid refrigerant is accumulated may be installed in the suction channel of the compressor 10.

The indoor heat exchanger 13 may have a refrigerant passage through which refrigerant passes.

The refrigeration cycle device may be a separation type air conditioner in which an indoor unit I and an outdoor unit O are separated, and in this case, the compressor 10 and the outdoor heat exchanger 11 may be installed inside the outdoor unit I. In addition, the refrigerating cycle device may be a refrigerator, the indoor heat exchanger 13 may be disposed to exchange heat with air in a food storage, and the outdoor heat exchanger 11 may exchange heat with air outside the food storage. In the case of a refrigerator, the indoor unit I and the outdoor unit O may be disposed together in a main body.

The expansion mechanism 12 may be installed in either the indoor unit I or the outdoor unit O.

The indoor heat exchanger 13 may be installed inside the indoor unit I.

An outdoor fan 15 for blowing outdoor air to the outdoor heat exchanger 11 may be installed in the outdoor unit O. In addition, the compressor 10 may be installed in a machine room of the outdoor unit O.

An indoor fan 16 for blowing indoor air to the indoor heat exchanger 13 may be installed in the indoor unit I.

Hereinafter, a heat exchanger of the present disclosure that suppresses inflow of water from the outside and improves discharge of internal water will be described. The heat exchanger may be used as the indoor heat exchanger 13 or/and the outdoor heat exchanger 11.

Figure 3:
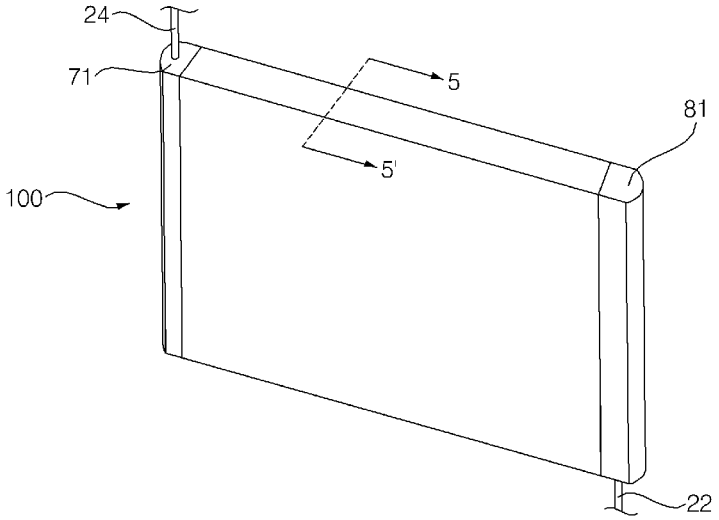
FIG. 3 is a perspective view of a heat exchanger according to one embodiment of the present disclosure.
Figure 4:
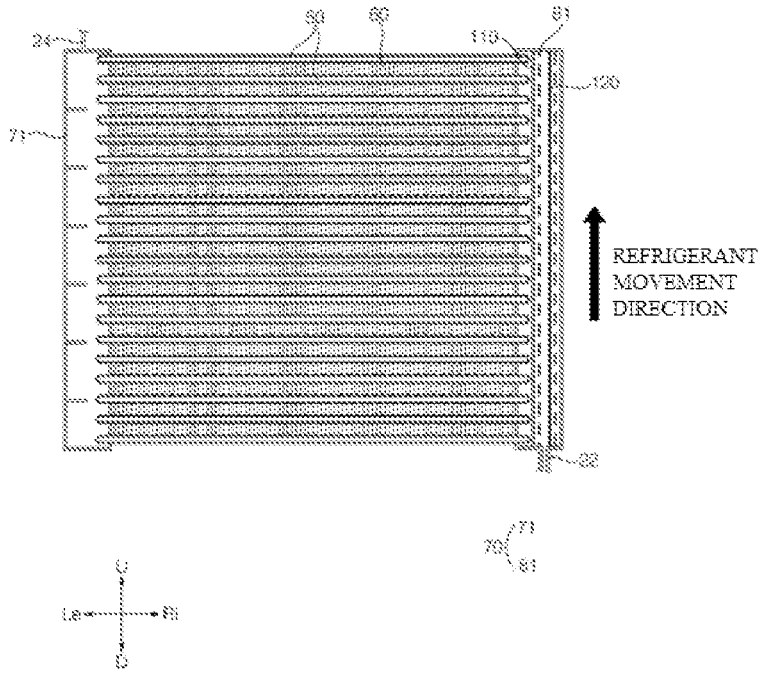
FIG. 4 is a longitudinal sectional view of the heat exchanger illustrated in FIG. 3.
Figure 5:
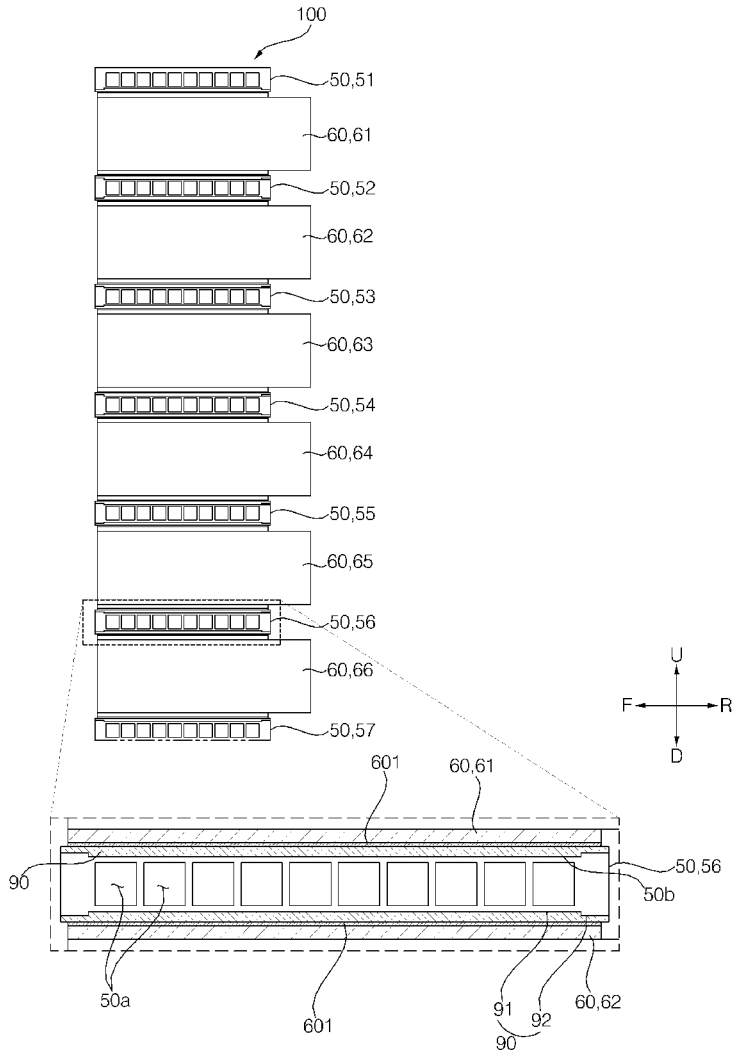
FIG. 5 is a cross-sectional view taken along line 5-5' of FIG. 3.

FIG. 3 is a perspective view of a heat exchanger according to one embodiment of the present disclosure, FIG. 4 is a longitudinal sectional view of the heat exchanger illustrated in FIG. 3, and FIG. 5 is a cross-sectional view taken along line 5-5' of FIG. 4.

Referring to FIGS. 3 to 5, a heat exchanger 100 is a device for exchanging heat between a refrigerant of a refrigeration cycle and external air. It is preferable that the heat exchanger 100 evenly distributes the refrigerant therein and has a wide heat transfer area.

The heat exchanger 100 may be arranged with a plurality of columns, and a moving direction of refrigerant may be alternately changed in one column.

For example, the heat exchanger 100 includes a plurality of refrigerant tubes 50 through which refrigerant flows, a fin 60 disposed between adjacent refrigerant tubes 50 to transfer heat, and a sacrificial sheet 90 having one surface which is in contact with the refrigerant tube 50 and the other surface which is in contact with the fin 60.

In addition, the heat exchanger 100 further includes a header 70 to which one end of each of a plurality of refrigerant tubes 50 is coupled to supply the refrigerant to the inside of the plurality of refrigerant tubes 50, and an outer pipe 110 inside the header 70 and an inner pipe 120 inside the outer pipe 110.

The refrigerant tube 50 has an extremely small inner diameter to maximize the contact area with air while the refrigerant flows therein. The plurality of refrigerant tubes 50 are connected to the header 70. The refrigerant tube 50 extends in a direction crossing the header 70.

Specifically, the refrigerant tube 50 may be disposed to be elongated in a horizontal (left-right) direction (LeRi), and a plurality of refrigerant tubes 50 may be stacked in a vertical direction (longitudinal direction) (UD). While air passes through the space between the plurality of refrigerant tubes 50 stacked in the vertical direction, heat exchange is performed between the air and the refrigerant in the refrigerant tube 50. The plurality of refrigerant tubes 50 stacked horizontally define a heat exchange surface together with fins 60 to be described later.

The refrigerant tube 50 may include a plurality of micro channels 50*a* therein. The plurality of micro-channels 50*a* provides a space through which the refrigerant passes. The plurality of micro channels 50*a* may extend in a direction parallel to the refrigerant tube 50.

Specifically, as illustrated in FIG. 5, the cross-sectional shape of the refrigerant tube 50 may be a rectangular shape with left and right sides longer than the top and bottom, and the cross-sectional shape of the microchannel 50*a* may be a rectangular shape.

The microchannels 50*a* may be stacked in one row in a direction (front-rear direction) (FR) crossing the longitudinal direction of the refrigerant tube 50.

The fin 60 transfers the heat of the refrigerant tube 50. The fin 60 increases the contact area with air to improve heat dissipation performance.

The fin 60 is disposed between the refrigerant tubes 50 adjacent to each other. The fin 60 may have various shapes, but may be formed by bending a plate having the same width as the refrigerant tube 50. The fin 60 may be coated with cladding 601.

The fin 60 may transfer heat by connecting two refrigerant tubes 50 stacked in the up down direction. The fin 60 may directly contact the refrigerant tube 50 or may be connected to the refrigerant tube 50 by a sacrificial sheet 90.

When viewed from the front-rear direction, a contact portion between the fin 60 and the sacrificial sheet 90 becomes a U-shape or V-shape. The fin 60 and the refrigerant tube 50 are alternately stacked in the up-down direction, and have a layout in which the refrigerant tube 50 is located at the uppermost end and the lowermost end.

When a refrigerant tube 50 located at the uppermost end is defined as first refrigerant tubes 50 and 51 and a refrigerant tube 50 located below the first refrigerant tubes 50 and 51 is defined as the second refrigerant tubes 50 and 52, a fin 60 between the first refrigerant tubes 50 and 51 and the second refrigerant tubes 50 and 52 may be defined as first fins 60 and 61. In this way, the nth refrigerant tube and the nth fin may be defined.

The header 70 is coupled to one end of each of the plurality of refrigerant tubes 50 to supply refrigerant into the plurality of refrigerant tubes 50. In addition, the header 70 may be coupled to one end of the refrigerant tube 50 to collect the refrigerant discharged from the refrigerant tube 50 and supply the collected refrigerant to another device.

The header 70 has a larger diameter, inner diameter or size than the refrigerant tube 50 and extends in the up-down direction. The header 70 may include a left header 71 connected to one end of the refrigerant tubes 50 and a right header 81 connected to the other end of the refrigerant tubes 50.

The right header 81 communicates with the right side of the plurality of refrigerant tubes 50. The right header 81 extends in the up-down direction and is connected to an inlet pipe 22. The inside of the right header 81 is formed as one space, and the refrigerant introduced through the inlet pipe 22 is distributed and supplied to the plurality of refrigerant tubes 50. The inlet pipe 22 is an example of a refrigerant supply unit.

The inlet pipe 22 is connected to a region adjacent to the lower end of the right header 81.

The left header 71 communicates with the left side of the plurality of refrigerant tubes 50. The left header 71 extends in the up-down direction and is connected to an outflow pipe 24. The inside of the left header 71 is formed as one space, and guides the refrigerant discharged to the upper side of the plurality of refrigerant tubes 50 to the outlet pipe 24.

Of course, the refrigerant discharged from the left header 71 may be supplied to the header 70 of another heat exchanger 100.

In the heat exchanger 100, the outer pipe 110 and the inner pipe 120 may be located to prevent the refrigerant from being biased inside the header 70. The refrigerant is uniformly distributed through holes of the outer pipe 110 and the inner pipe 120.

The sacrificial sheet 90 has one surface in contact with the refrigerant tube 50 and the other surface in contact with the fin 60, and the sacrificial sheet 90 is corroded instead of the fin 60 and the refrigerant tube 50 to suppress corrosion of the fin 60 and the refrigerant tube 50 and peeling of the fin 60 and the refrigerant tube 50.

For example, a corrosion potential of the sacrificial sheet 90 may be lower than that of the refrigerant tube 50. When corrosion occurs in a state where the two metals are in contact, since the metal with the lowest corrosion potential is corroded, the sacrificial sheet 90 instead of the refrigerant tube 50 is corroded to prevent the refrigerant tube 50 from being corroded and the refrigerant from leaking.

In addition, the corrosion potential of the sacrificial sheet 90 may be lower than that of the fin 60. Even when only the refrigerant tube 50 is not corroded, there is no problem because the refrigerant is prevented from leaking. However, when the fin 60 is corroded, the flow of air is hindered and the efficiency of the refrigerant is lowered, and thus, it is preferable that the corrosion potential of the sacrificial sheet 90 is lower than that of the fin 60.

When the corrosion potential of the sacrificial sheet 90 is lower than that of the fins 60, the sacrificial sheet 90 is corroded first instead of the fins 60, thereby preventing corrosion of the fins 60.

Preferably, the corrosion potential of the fin 60 may be lower than that of the refrigerant tube 50. In a case where both the fin 60 and the refrigerant tube 50 are corroded, it is more problematic when the refrigerant tube 50 is corroded. When the fin 60 is corroded, there is a problem in that efficiency is slightly lowered, but when the refrigerant tube 50 is corroded, the refrigerant leaks out and the air conditioner does not operate, which causes a major problem.

Therefore, in the present disclosure, the corrosion potential of the fin 60 lower than that of the refrigerant tube 50, and thus, the fin 60 corrodes first before the refrigerant tube 50, and the corrosion of the refrigerant tube 50 is prevented.

In conclusion, the corrosion potential of the sacrificial sheet 90 may be lower than that of the refrigerant tube 50, the corrosion potential of the sacrificial sheet 90 may be lower than that of the fin 60, the corrosion potential of the fin 60 may be lower than that of the refrigerant tube 50.

Figure 6:
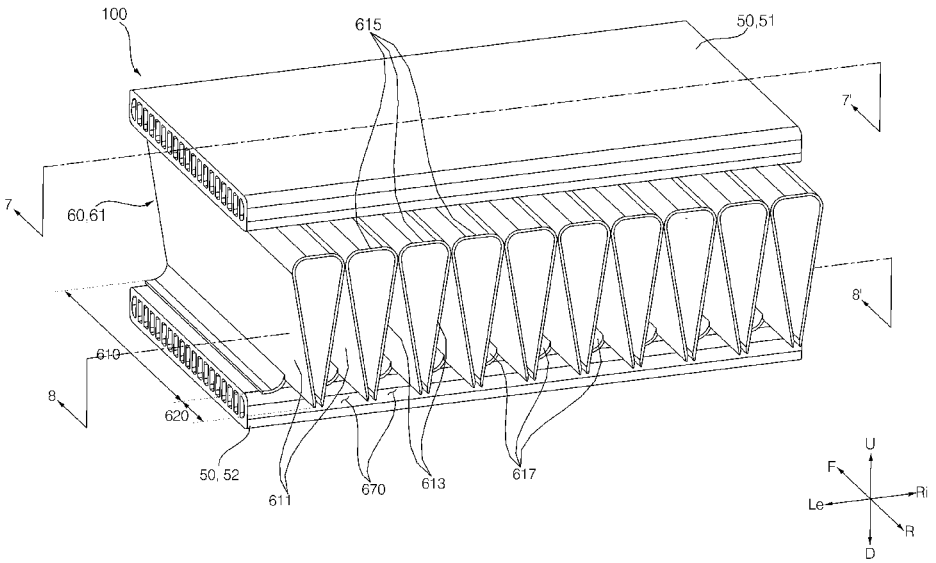
FIG. 6 is a perspective view of a partial area of FIG. 5.
Figure 7:
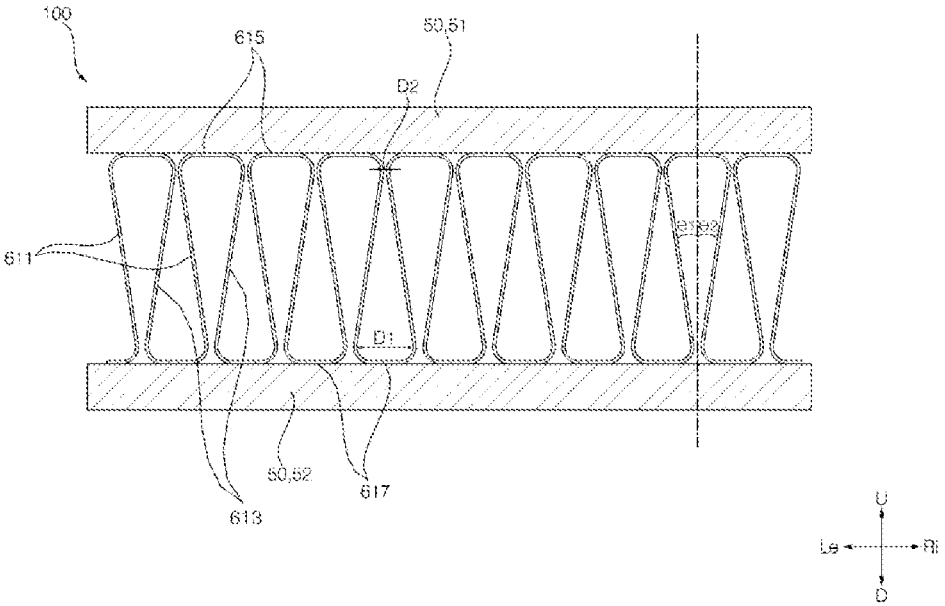
FIG. 7 is a cross-sectional view taken along line 7-7' of FIG. 6.
Figure 8:
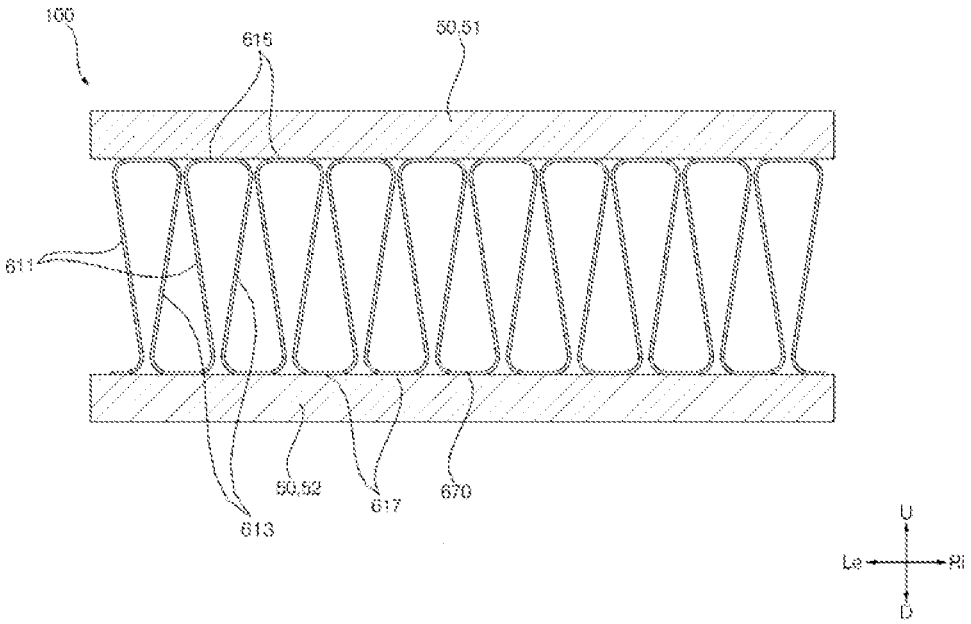
FIG. 8 is a cross-sectional view taken along line 8-8' of FIG. 6.

FIG. 6 is a perspective view of a partial area of FIG. 5, FIG. 7 is a cross-sectional view taken along line 7-7' of FIG. 6, and FIG. 8 is a cross-sectional view taken along line 8-8' of FIG. 6.

Referring to FIG. 6, the fin 60 may be formed by bending a plurality of bodies. For example, the fin 60 may include a plurality of first bodies 611, a plurality of second bodies 613 located between the plurality of first bodies 611, an upper body 615 which connects an upper end of the first body 611 and an upper end of the second body 613 adjacent to each other, and a lower body 617 which connects a lower end of the first body 611 and a lower end of the second body 613 adjacent to each other.

The upper body 615 is connected to the lower end of the refrigerant tube 50 located on the upper side of the refrigerant tubes 50 adjacent to each other, and the lower body 617 is connected to the upper end of the refrigerant tube 50 located on the lower side of the refrigerant tubes 50 adjacent to each other.

The upper body 615 of the first fin 61 is connected to the lower end of the first refrigerant tube 51, and the lower body 617 of the first fin 61 is connected to the upper end of the second refrigerant tube 52.

A portion of the upper body 615 is located not to overlap with the lower body 617 in the vertical direction. The upper body 615 and the lower body 617 are alternately located in a left-right direction. Specifically, a central portion of the upper body 615 is located so as not to overlap with a central portion of the lower body 617 in the vertical direction.

A distance between the first body 611 and the second body 613 connected to both ends of each lower body 617 decreases as it approaches the upper body 615. Of course, the distance between the first body 611 and the second body 613 connected to both ends of each lower body 617 may gradually or stepwise decrease as it approaches the upper body 615.

A distance between the first body 611 and the second body 613 connected to both ends of each upper body 615 decreases as it approaches the lower body 617. Of course, the distance between the first body 611 and the second body 613 connected to both ends of each upper body 615 may gradually or stepwise decrease as it approaches the lower body 617.

When the distance between the first body 611 and the second body 613 connected to both ends of each lower body 617 decreases as it approaches the upper body 615, the space between the first body 611 and the second body 613 is widened as it approaches downward, water moves to the lower portions of the fins by gravity due to the weight of water located between the first body 611 and the second body 613 rather than an interfacial tension between the lower end of the first body 611 and the lower end of the second body 613, and thus, the water driven to the lower portions of the fins is discharged through the forward and backward ends of the fins. Therefore, the water between the fins is easily discharged.

Each first body 611 may have a first inclination angle θ1 in the vertical direction, and each second body 613 may have a second inclination angle θ2 in the vertical direction. The first inclination angle θ1 and the second inclination angle θ2 may be different or the same.

Of course, as described later with reference to FIG. 22, in another embodiment, the first body 611 and the second body 613 may extend parallel to the vertical direction.

Preferably, the first inclination angle (θ1) has the same angle as the second inclination angle (θ2) and may be inclined in the opposite direction. That is, on a vertical line drawn vertically from the center of the upper body 615, the first body 611 may extend in a direction between the left and upper directions, and the second body 613 may extend in a direction between the right and upper directions.

The distance between the first body 611 and the second body 613 connected to both ends of each upper body 615 decreases as it approaches the lower body 617 and may not be 0 at the same height as the lower body 617. That is, the lower end of the first body 611 and the lower end of the second body 613 connected to both ends of each upper body 615 may be spaced apart from each other. Of course, depending on the embodiment, the lower end of the first body 611 and the lower end of the second body 613 connected to both ends of each upper body 615 may be in contact with each other.

Here, the distance between the first body 611 and the second body 613 at the same height as the lower body 617 means a separation distance between portions of the first body 611 and the second body 613 having the same height as the lower body 617.

The distance between the first body 611 and the second body 613 connected to both ends of each lower body 617 may not be zero at the same height as the upper body 615. That is, the upper end of the first body 611 and the upper end of the second body 613 connected to both ends of each lower body 617 may be spaced apart from each other. Of course, depending on the embodiment, the upper end of the first body 611 and the upper end of the second body 613 connected to both ends of each lower body 617 may be in contact with each other.

Here, at the same height as the upper body 615, the distance between the first body 611 and the second body 613 means a separation distance between portions of the first body 611 and the second body 613 having the same height as the upper body 615.

A portion where the upper body 615 is connected to the first body 611 and the second body 613 may be rounded. A portion where the lower body 617 is connected to the first body 611 and the second body 613 may be rounded.

In addition, a distance D1 between the lower end of the first body 611 and the lower end of the second body 613 connected to both ends of each lower body 617 may be larger than a distance D2 between the upper end of the first body 611 and the upper end of the second body 613 connected to both ends of each lower body 617.

The distance between the lower end of the first body 611 and the lower end of the second body 613 connected to both ends of each upper body 615 may be smaller than the distance between the upper end of the first body 611 and the upper end of the second body 613 connected to both ends of each upper body 615.

Since a portion of the fin 60 protrudes to the outside of the refrigerant tube 50, it is possible to suppress the inflow of water from the outside, and to easily discharge water condensed in the space between the fins 60 to the outside.

Each fin 60 may include an inner portion 610 that is located to overlap the refrigerant tubes 50 in a first direction (up-down direction), and an outer portion 620 that is not located to overlap the refrigerant tubes 50 in the first direction.

Specifically, the outer portion 620 is connected to the rear end of the inner portion 610 and is located behind the inner portion 610. The refrigerant tube 50 is not disposed below and above the outer portion 620.

A length of the inner portion 610 in the front-rear direction may be longer than that of the outer portion 620 in the front-rear direction. This is because the area for heat exchange with the refrigerant tube 50 is reduced when the length of the inner portion 610 is shorter than that of the outer portion 620. In the inner portion 610, the heat of the refrigerant tube 50 is transferred to the fin 60, and even when external water is introduced from the outer portion 620, the lower portion of the outer portion 620 is not blocked by the tube, and thus, a surface tension is weaker than the force of gravity, causing the water to fall.

The water located in the space between the fins 60 in the inner portion 610 spreads in a horizontal direction due to surface tension, a portion of the water that has spread long falls downward from the outer portion 620, the water in the inner portion 610 is moved to the outer portion 620 by surface tension and viscosity, the water moved to the outer portion 620 falls again by gravity, and thus, water condensed in the space between the fins 60 is easily discharged to the outside.

A front-rear width of the outer portion 620 may be smaller than the separation distance between adjacent refrigerant tubes 50. This is because when the front-rear width of the outer portion 620 is larger than the separation distance between adjacent tubes, the heat exchange area is reduced, the heat exchange efficiency is reduced, and ability to suppress the inflow of the water is not improved.

The fin 60 may further include a body opening portion 670 passing through at least a portion of the lower body 617 located in the outer portion. The body opening portion 670 may be formed by passing through a portion or the entire of the lower body 617 located in the outer portion.

The water located between the first body 611 and the second body 613 spreads down and to the side due to its own weight, and falls from the body opening portion 670 to the lower portion of the outer portion.

Figure 9:
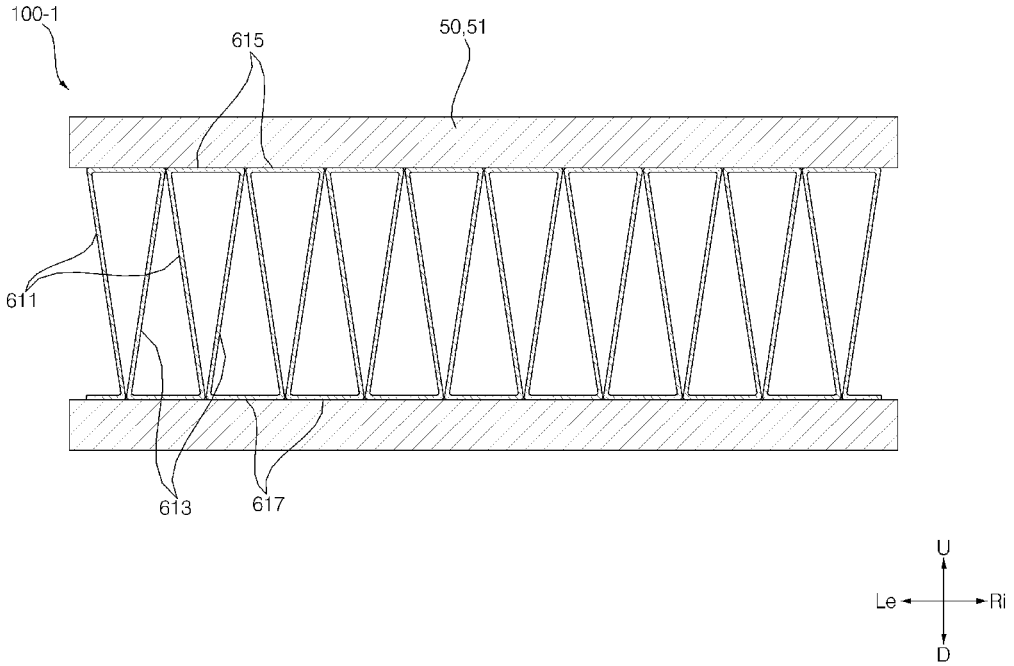
FIG. 9 is a partial cross-sectional view of a heat exchanger according to another embodiment of the present disclosure.

FIG. 9 is a view illustrating a portion of a heat exchanger 100-1 according to another embodiment of the present disclosure.

Compared to the embodiment of FIG. 7, the heat exchanger 100-1 according to another embodiment of the present disclosure has a difference in the structure of the fin. Hereinafter, a description will be made focusing on the differences from FIG. 7, and parts without special explanation are considered to be the same as the embodiment of FIG. 7.

The distance between the first body 611 and the second body 613 connected to both ends of each upper body 615 decreases as it approaches the lower body 617, and becomes 0 at the same height as the lower body 617. That is, the lower end of the first body 611 and the lower end of the second body 613 connected to both ends of each upper body 615 are in contact with each other.

The distance between the first body 611 and the second body 613 connected to both ends of each lower body 617 is Oat the same height as the upper body 615. That is, the upper end of the first body 611 and the upper end of the second body 613 connected to both ends of each lower body 617 are in contact with each other.

Figure 10:
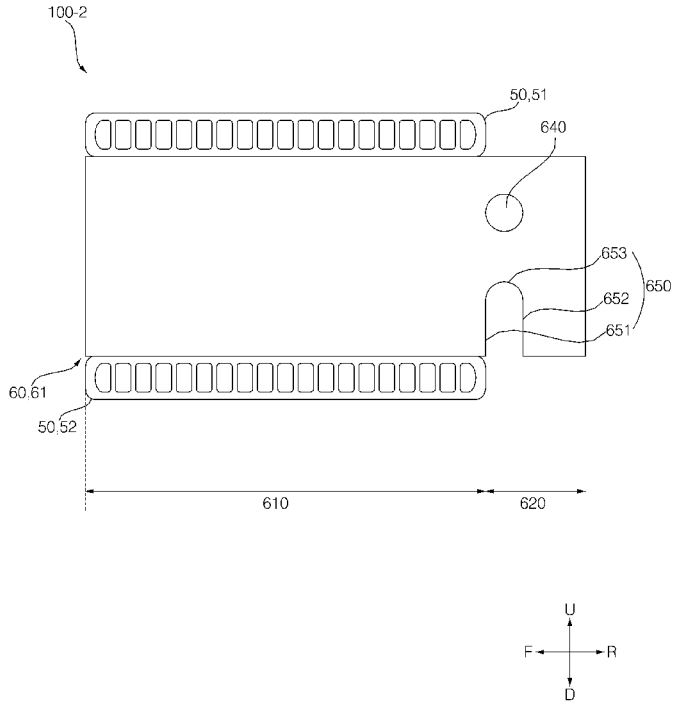
FIG. 10 is a diagram illustrating a part of a heat exchanger according to another embodiment of the present disclosure.
Figure 11:
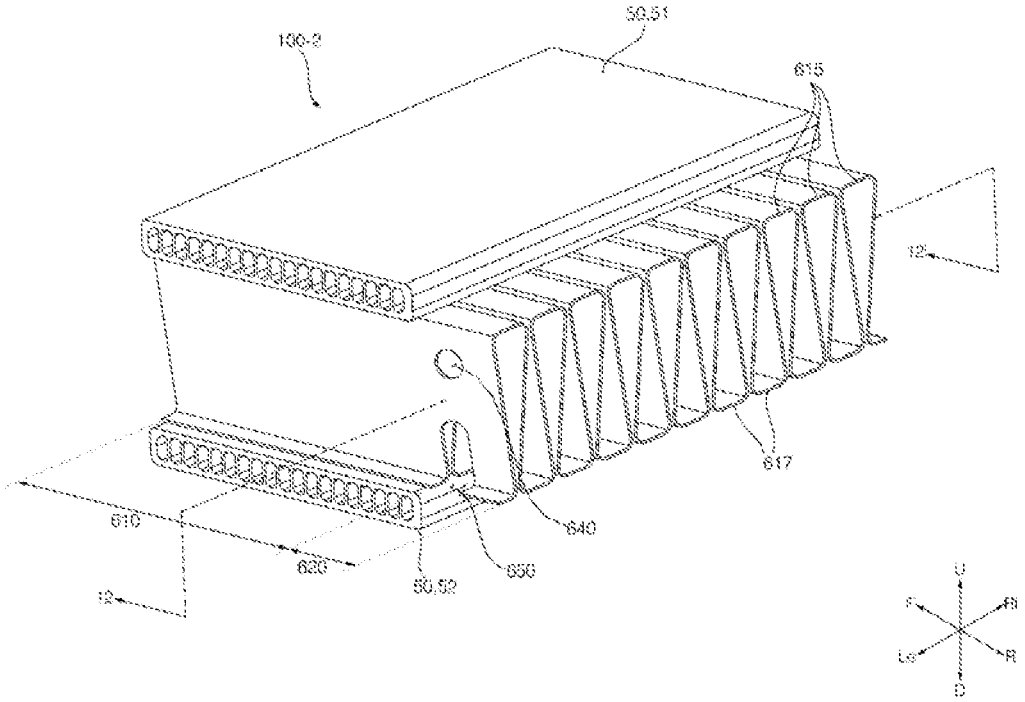
FIG. 11 is a perspective view of the heat exchanger of FIG. 10.
Figure 12:
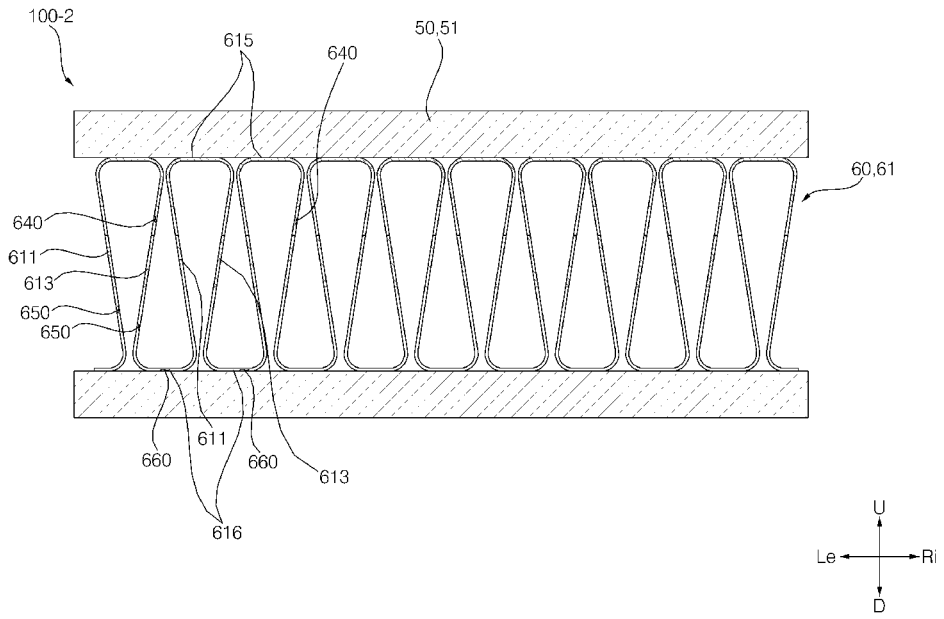
FIG. 12 is a cross-sectional view taken along line 12-12' of FIG. 11.

FIG. 10 is a diagram illustrating a part of a heat exchanger 100-2 according to another embodiment of the present disclosure, FIG. 11 is a perspective view of the heat exchanger of FIG. 10, and FIG. 12 is a cross-sectional view taken along line 12-12' of FIG. 11.

Compared to the embodiments of FIGS. 6 to 8, the heat exchanger 100-2 according to another embodiment of the present disclosure further includes a drain groove 650 or/and an inflow prevention hole 640. Hereinafter, differences from FIGS. 6 to 8 will be mainly described, and parts without special explanation will be regarded as the same as the embodiments of FIGS. 6 to 8.

Referring to FIGS. 10 to 12, the drain groove 650 may be formed in the outer portion 620 to prevent inflow of external water. The drain groove 650 may have a shape in which the fin 60 opens downward when viewed from the left direction.

Each fin 60 is formed by bending several bodies, and the drain groove 650 may be formed in each body so that the outer portion 620 defines a downwardly open groove when viewed from the left direction.

The water located in the space between the fins 60 spreads long in a horizontal direction due to surface tension and is collected downward of the fin 60 by gravity. The drain groove 650 increases a falling force of the water collected downward so that the water is easily discharged, and the water introduced from the outer portion 620 to the inner portion 610 falls so that the outside water is not easily introduced.

The drain groove 650 may have various structures in which the lower end of the fin 60 is recessed upward.

For example, the drain groove 650 may include a first groove surface 651 and a second groove surface 652 that extend in a first direction and are spaced apart from each other, and a connection surface 653 which connects one end of the first groove surface 651 and the second groove surface 652 to each other.

Specifically, in the drain groove 650, the first groove surface 651 and the second groove surface 652 may be spaced apart in the front-rear direction and extend in an up-down direction, and the connection surface 653 may connect the upper end of the first groove surface 651 and the upper end of the second groove surface 652 to each other.

The connecting surface 653 may have a straight-line shape or rounded shape. In FIG. 10, the connection surface 653 has a round shape convex upward, but is not limited thereto.

The drain groove 650 may be located in various positions in the outer portion 620. For example, one end of the drain groove 650 may be connected to the inner portion 610. Specifically, the first groove surface 651 of the drain groove 650 may be located at a boundary between the inner portion 610 and the outer portion 620. The drain groove 650 may be located close to the inner portion 610 from the outer portion 620.

When the drain groove 650 is located close to the inner portion 610, the width of the outer portion 620 may be reduced, and the water expanded in the space between the fins 60 can effectively fall from the drain groove 650.

The outer portion 620 may further include the inflow prevention hole 640 to prevent inflow of external water. The inflow prevention hole 640 may be formed by penetrating the outer portion 620 of the fin 60 in the left-right direction.

The inflow prevention hole 640 may be located above the drain groove 650. The inflow prevention hole 640 may be located to overlap the drain groove 650 in the up-down direction. A diameter of the inflow prevention hole 640 is preferably shorter than a vertical length of the drain groove 650.

The water introduced from the outside is located in the space between the fins 60 of the outer portion 620, a portion of the water falls downward due to gravity and the action of the drain groove 650, but a portion of the water may flow into the inner portion 610 from the upper portion of the outer portion 620 due to surface tension, and the inflow prevention hole 640 suppresses the inflow of water.

The drain groove 650 may be formed on the first bodies 611 and the second bodies 613. The lower body 617 may further include a connection hole 660 connecting drain grooves 650 formed in the first body 611 and the second body 613 adjacent to each other.

Of course, according to the embodiment, when the fins 60 have a structure in which the first body 611 and the second body 613 are bent to have an inclination to each other and the upper body 615 and the lower body 617 are omitted, the configuration of the connection hole 660 may be omitted.

Each of the drain grooves 650 formed on the first body 611 and the second body 613 may be overlapped with each other in the left-right direction.

The inflow prevention hole 640 is formed in the first bodies 611 and the second bodies 613. Each of the inflow prevention holes 640 formed in the first body 611 and the second body 613 may be overlapped with each other in the left-right direction.

Figure 13:
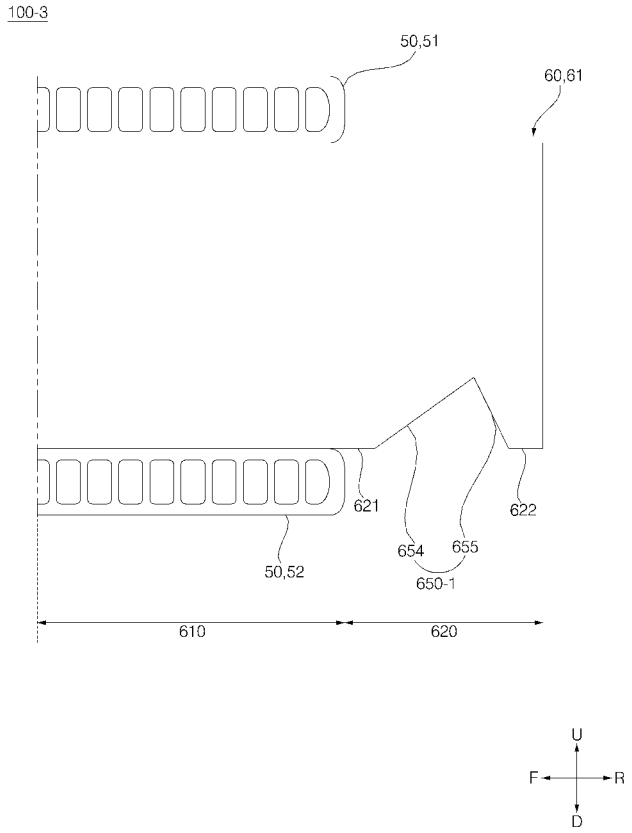
FIG. 13 is a diagram illustrating a part of a heat exchanger according to another embodiment of the present disclosure.

FIG. 13 is a diagram illustrating a part of a heat exchanger according to another embodiment of the present disclosure.

Compared to the embodiment of FIG. 10, in a heat exchanger 100-3 according to another embodiment of the present disclosure, the inflow prevention hole 640 is omitted and there is a difference in the structure of the drain groove 650. Hereinafter, a description will be made focusing on the differences from FIG. 10, and parts without special explanation will be regarded as the same as the embodiment of FIG. 10.

Referring to FIG. 13, a drain groove 650-1 of another embodiment of the present disclosure may include a first inclined surface 654 having an inclination in the first direction (up-down direction), and a second inclined surface 655 having an inclination in the first direction and connected to one end of the first inclined surface 654.

The first inclined surface 654 is inclined upward toward the rear, the second inclined surface 655 inclined downward toward the rear, and a rear end of the first inclined surface 654 is connected to a front end of the second inclined surface 655. The first inclined surface 654 may be located closer to the refrigerant tube 50 than the second inclined surface 655.

Each of the first inclined surface 654 and the second inclined surface 655 may have a straight-line shape or a round shape. When the drain groove 650-1 has two inclined surfaces, water between the fins 60 of the inner portion 610 spreads in the horizontal direction due to gravity and surface tension and accumulates at the lower portion of the fin 60. Since the first inclined surface 654 is long in the front-rear direction, gravity is strongly applied to the water diffused from the inner portion 610, and thus, the internal water can be discharged more efficiently.

Of course, the water of the outer portion 620 is more effectively prevented from flowing into the inner portion 610 by the gravitational effect of the second inclined surface 655.

It is preferable that the length of the first inclined surface 654 is larger than that of the second inclined surface 655. Since it is important to discharge the water formed on the inner portion 610 to the outer portion 620, the gravitational effect may be increased by increasing the length of the first inclined surface 654.

The drain groove 650-1 may be located backward from the inner portion 610. When the drain groove 650-1 is located away from the inner portion 610, the water expanded by the surface tension in the inner portion 610 falls to the portions of the outer portions 620 and 621 and the drain groove 650-1 without the refrigerant tube 50 below due to the gravitational effect. That is, the gravitational effect of the outer portion 620 and the drain groove 650-1 may act double, thereby increasing drainage efficiency.

The water expanded by the surface tension in the outer portion 620 falls due to the gravitational effect at the outer portions 620 and 622 and the drain groove 650-1 located behind the drain groove 650-1.

Figure 14:
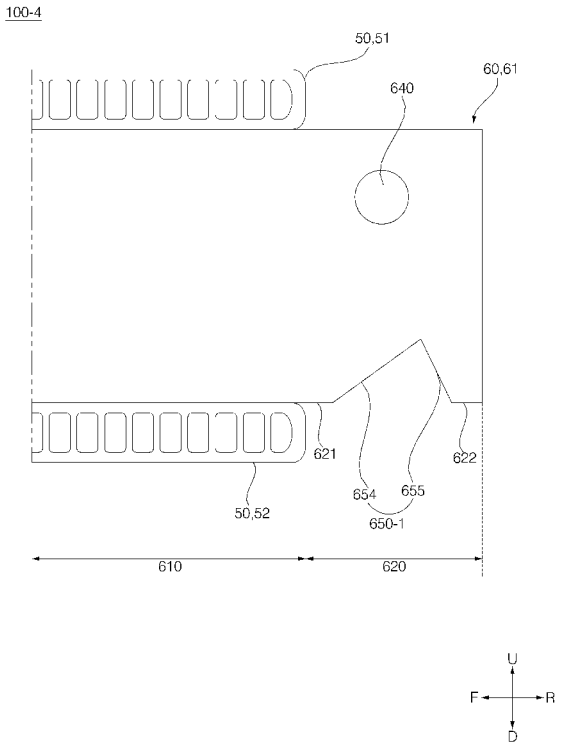
FIG. 14 is a diagram illustrating a part of a heat exchanger according to another embodiment of the present disclosure.

FIG. 14 is a diagram illustrating a part of a heat exchanger 100-4 according to another embodiment of the present disclosure.

Compared to the embodiment of FIG. 13, the heat exchanger 100-4 according to another embodiment of the present disclosure further includes an inflow prevention hole 640. Hereinafter, a description will be made focusing on the differences from FIG. 13, and parts without special explanation will be regarded as the same as the embodiment of FIG. 13.

Referring to FIG. 14, an inflow prevention hole 640 according to another embodiment of the present disclosure may be formed in an outer portion 620. The inflow prevention hole 640 may be located above the drain groove 650-1.

Figure 15:
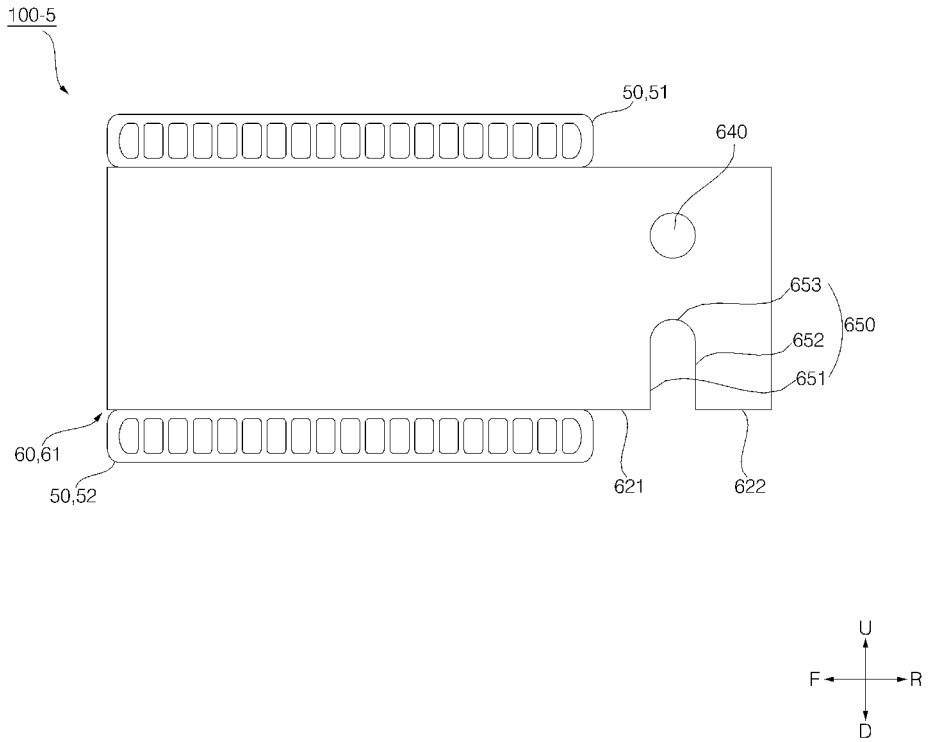
FIG. 15 is a diagram illustrating a part of a heat exchanger according to another embodiment of the present disclosure.

FIG. 15 is a diagram illustrating a part of a heat exchanger 100-5 according to another embodiment of the present disclosure.

Compared to the embodiment of FIG. 10, in the heat exchanger 100-5 according to another embodiment of the present disclosure, there is a difference in the positions of the inflow prevention hole 640 and the drain groove 650. Hereinafter, a description will be made focusing on the differences from FIG. 10, and parts without special explanation will be regarded as the same as the embodiment of FIG. 10.

Referring to FIG. 15, the drain groove 650 according to another embodiment of the present disclosure may be spaced apart from the inner portion 610. That is, the drain groove 650 may be spaced apart from the rear end of the inner portion 610 to the rear. Drainage occurs in the outer portion 621 in front of the drain groove 650 and the outer portion 622 in the rear of the drain groove 650.

An inflow prevention groove according to another embodiment of the present disclosure may be located above the drain groove 650. The inflow prevention groove may be located to overlap the drain groove 650 in the up-down direction.

Figure 16:
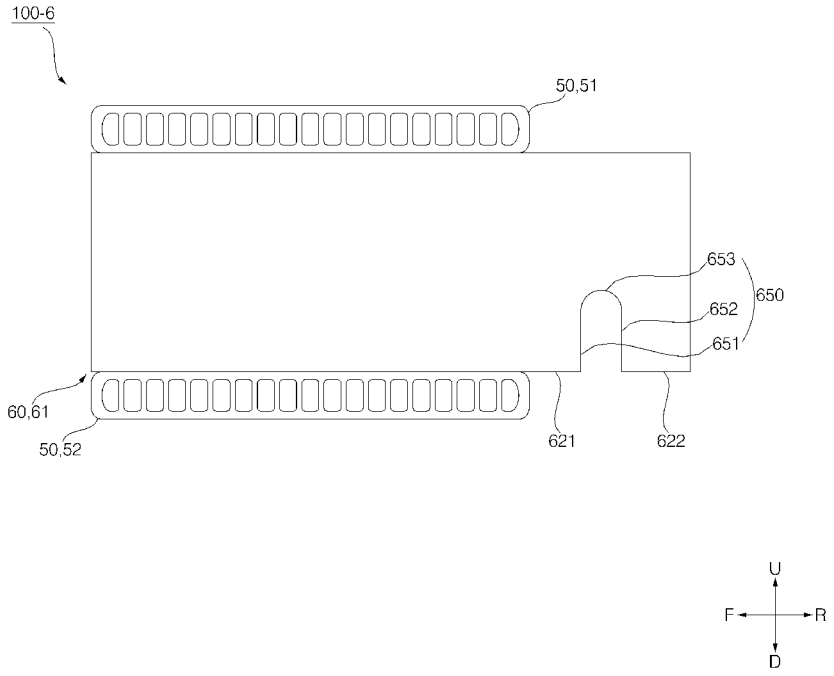
FIG. 16 is a diagram illustrating a part of a heat exchanger according to another embodiment of the present disclosure.

FIG. 16 is a diagram illustrating a part of a heat exchanger 100-6 according to another embodiment of the present disclosure.

Compared to the embodiment of FIG. 15, in the heat exchanger 100-6 according to another embodiment of the present disclosure, there is a difference in that the inflow prevention hole 640 is omitted. Hereinafter, a description will be made focusing on the differences from FIG. 15, and parts without special explanation will be regarded as the same as the embodiment of FIG. 15.

Referring to FIG. 16, a drain groove 650 according to another embodiment of the present disclosure may be spaced apart from the inner portion 610. That is, the drain groove 650 may be spaced apart from a rear end of the inner portion 610 to the rear. In the heat exchanger of another embodiment of the present disclosure, the inflow prevention hole 640 is omitted.

Of course, although not illustrated in the drawing, in another embodiment of the present disclosure, the drain groove 650 may be omitted in FIG. 6 and only the inflow prevention hole 640 may be included.

Figure 17:
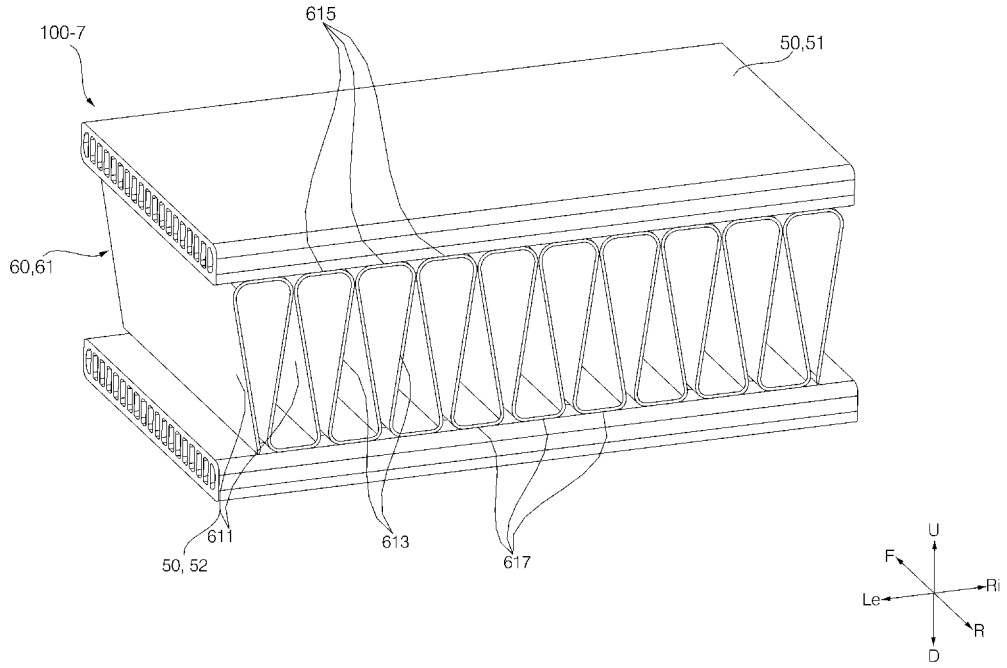
FIG. 17 is a diagram illustrating a part of a heat exchanger according to another embodiment of the present disclosure.

FIG. 17 is a diagram illustrating a part of a heat exchanger 100-7 according to another embodiment of the present disclosure.

Compared to the embodiment of FIG. 6, there is a difference in the structure of the fin 60 in the heat exchanger 100-7 according to another embodiment of the present disclosure. Hereinafter, a description will be made focusing on differences from FIG. 6, and parts without special explanation will be regarded as the same as the embodiment of FIG. 6.

Referring to FIG. 17, the fins 60 of another embodiment of the present disclosure are located to completely overlap the refrigerant tubes 50 in the first direction. That is, compared with FIG. 6, the outer portion 620 of the fin 60 is omitted.

Figure 18:
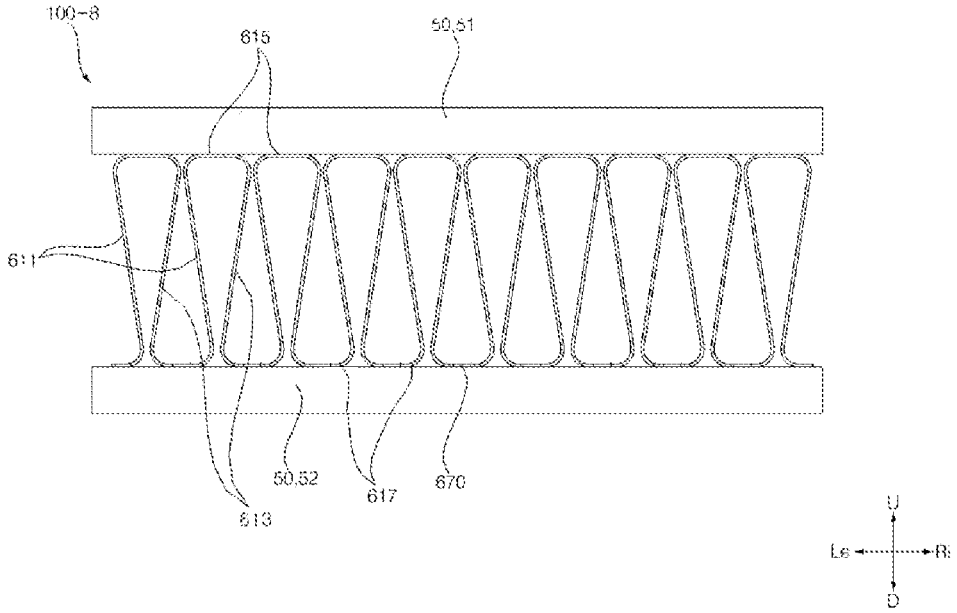
FIG. 18 is a cross-sectional view of a heat exchanger according to another embodiment of the present disclosure.
Figure 19:
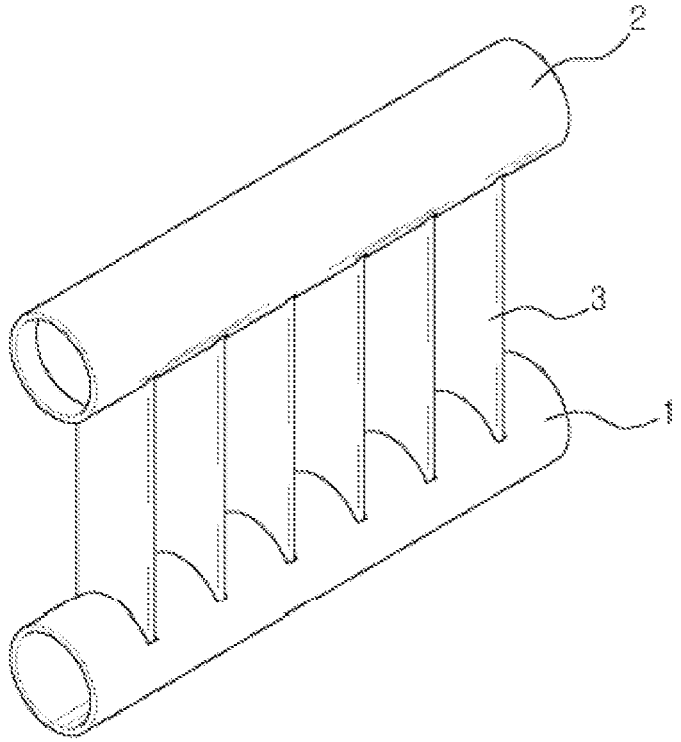
Fig. 19 RELATED ART
FIG. 19 is a perspective view briefly illustrating an external appearance of a heat exchanger according to the related art.
Figure 20:
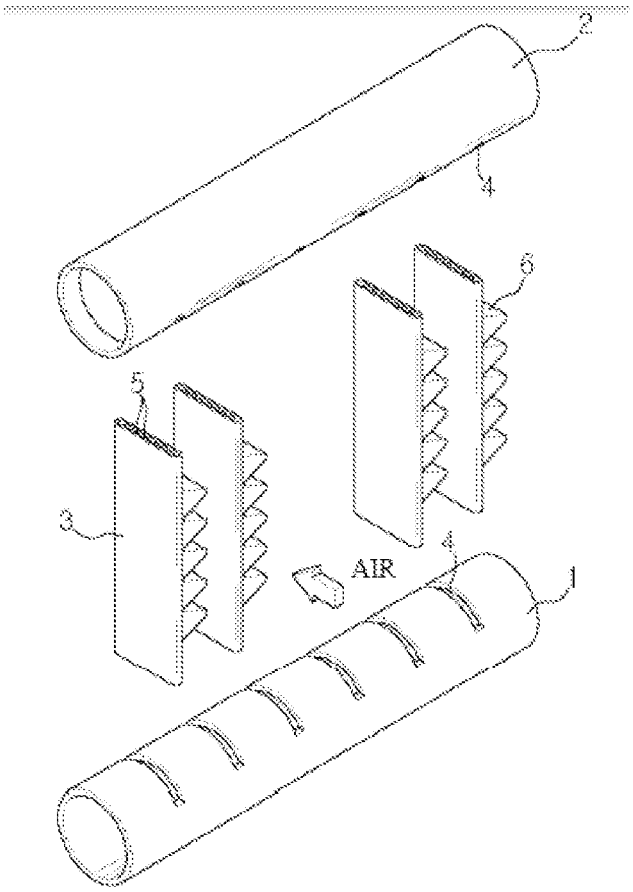
Fig. 20 RELATED ART
FIG. 20 is an exploded view illustrating a coupling relationship of components of the heat exchanger according to the related art.
Figure 21:
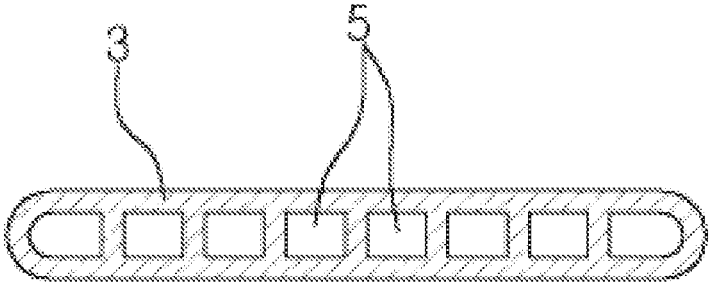
Fig. 21 RELATED ART
FIG. 21 is a view illustrating a cross section of the tube in FIG. 20.

FIG. 18 is a cross-sectional view of a heat exchanger 100-8 according to another embodiment of the present disclosure.

Compared to the embodiment of FIG. 8, in the heat exchanger 100-8 according to another embodiment of the present disclosure, there is a difference in the structure of the body opening portion 670. Hereinafter, a description will be made focusing on the differences from FIG. 8, and parts without special explanation will be regarded as the same as the embodiment of FIG. 8.

Referring to FIG. 18, a body opening portion 670 according to another embodiment of the present disclosure may be formed by penetrating a portion of the lower body 617 located in the outer portion 620. The body opening portion 670 may be formed in the form of a hole in the lower body 617 located in the outer portion 620.

Figure 22:
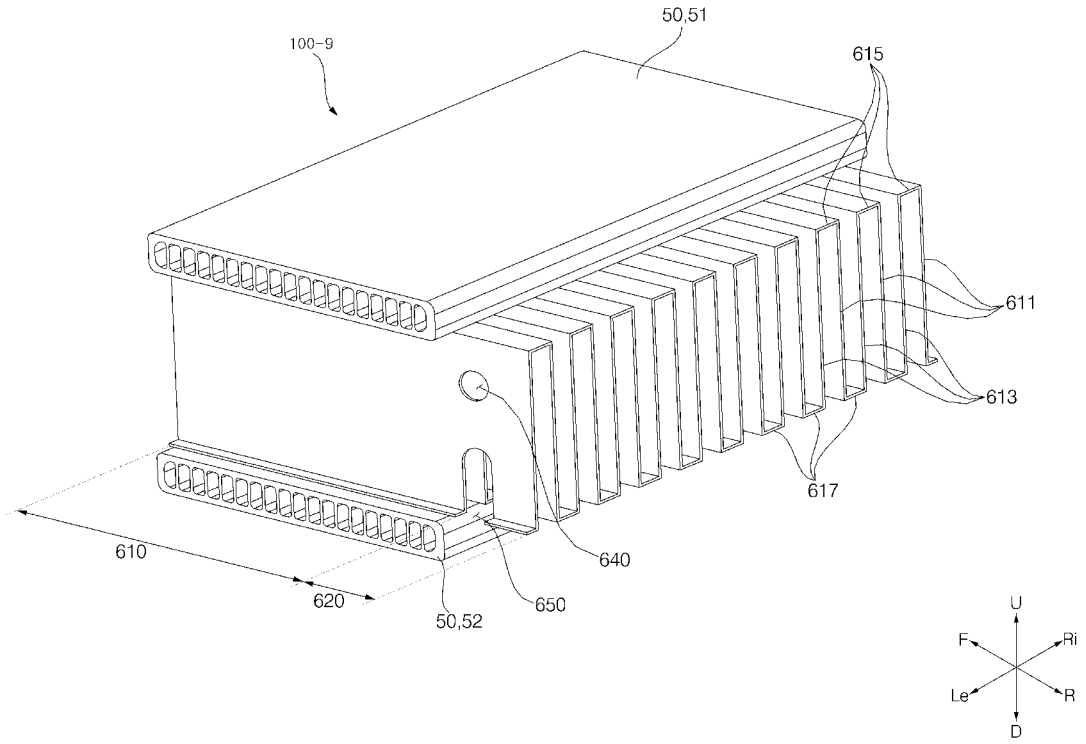
FIG. 22 is a perspective view of a heat exchanger according to another embodiment of the present disclosure.

FIG. 22 is a perspective view of a heat exchanger according to another embodiment of the present disclosure.

Compared to the embodiment of FIG. 11, in the heat exchanger 100-9 according to another embodiment of the present disclosure, there is a difference in the structure of the first body 611 and the second body 613. Hereinafter, differences from FIG. 11 will be mainly described, and parts without special explanation will be regarded as the same as the embodiment of FIG. 11.

Referring to FIG. 22, the first body 611 and the second body 613 according to another embodiment of the present disclosure may extend parallel to the vertical direction.

The heat exchanger of the present disclosure has one or more of the following effects.

First, in the present disclosure, since the bodies of the fins have an inclination to each other, the space between the bodies becomes wider toward the bottom, the water is collected at the lower portion by the gravity due to the weight of the water located between the bodies rather than the interfacial tension between the bodies. Therefore, the water between the fins is easily discharged through both ends of the fins.

Second, in the present disclosure, the fin has the inner region overlapping each other in one direction with a plurality of tubes adjacent to each other, and the outer region that does not overlap each other. Accordingly, even when heat in the tube is transferred to the fins in the inner region and external water is introduced from the outer region, since the lower portion of the outer region is not blocked by the tube, the surface tension is weaker than the gravity, and thus, the water falls.

Third, in the present disclosure, the water located in the space between the fins in the inner region spreads long in a horizontal direction due to the surface tension, a portion of the water that spreads long falls downward from the outer area, the water in the inner region is moved to the outer region by surface tension and viscosity, and the water moved to the outer region falls again by gravity. Accordingly, the water condensed in the space between the fins is easily discharged to the outside.

Fourth, in the present disclosure, since the drain groove is formed between the inner region and the outer region of the fin, when the water located in the space between the fins spreads long in the horizontal direction by the surface tension, the water is easily discharged by increasing the falling force of the water. Accordingly, the water introduced from the outer region to the inner region falls, and the external water cannot easily be introduced.

Fifth, since the present disclosure includes an inflow prevention hole in the outer region of the fin, water in the outer region is prevented from diffusing into the inner region due to the surface tension.

The above-described features, configurations, effects, and the like are included in at least one of the embodiments of the present disclosure, and should not be limited to only one embodiment. In addition, the features, configurations, effects, and the like as illustrated in each embodiment may be implemented with regard to other embodiments as they are combined with one another or modified by those skilled in the art. Thus, content related to these combinations and modifications should be construed as including in the scope and spirit of the disclosure as disclosed in the accompanying claims.

What is claimed is:

1. A heat exchanger comprising:

a plurality of refrigerant tubes configured to allow a refrigerant to flow therethrough; and a fin disposed between adjacent refrigerant tubes, the fin being configured to transfer heat, wherein the fin comprises:

a plurality of first bodies;

a plurality of second bodies, each second body being arranged between adjacent first bodies;

a plurality of upper bodies, each upper body connecting an upper end of a first body of the plurality of first bodies and an upper end of a second body of the plurality of second bodies that are located adjacent to each other;

a plurality of lower bodies, each lower body connecting a lower end of a first body of the plurality of first bodies and a lower end of a second body of the plurality of second bodies that are located adjacent to each other;

an inner portion overlapping the plurality of refrigerant tubes in a first direction; and an outer portion not overlapping the plurality of refrigerant tubes in the first direction, and wherein a distance between a first body of the plurality of first bodies and a second body of the plurality of second bodies that are connected to both ends of one lower body of the plurality of lower bodies decreases moving in a direction toward one upper body of the plurality of upper bodies.

2. The heat exchanger of claim 1, wherein a distance between a first body of the plurality of first bodies and a second body of the plurality of second bodies that are connected to both ends of the one upper body decreases moving in a direction toward the one lower body.

3. The heat exchanger of claim 1, wherein each first body is inclined at a first inclination angle with respect to a vertical direction, and wherein each second body is inclined at a second inclination angle with respect to the vertical direction.

4. The heat exchanger of claim 3, wherein the first inclination angle and the second inclination angle are the same angle and are inclined in directions opposite to each other.

5. The heat exchanger of claim 1, wherein a distance between a first body of the plurality of first bodies and a second body of the plurality of second bodies that are connected to both ends of the one upper body decreases moving in a direction toward the one lower body, and the first body and the second body come into contact with each other at a same height as the one lower body.

6. The heat exchanger of claim 1, wherein a first body of the plurality of first bodies and a second body of the plurality of second bodies that are connected to both ends of the one lower body come into contact with each other at a same height as the one upper body.

7. The heat exchanger of claim 1, wherein a portion where the one upper body connected to one first body of the plurality of first bodies and one second body of the plurality of second bodies is rounded.

8. The heat exchanger of claim 1, wherein a portion where the one lower body connected to one first body among the plurality of first bodies and one second body of the plurality of second bodies is rounded.

9. The heat exchanger of claim 1, wherein the one upper body is connected to a lower end of one refrigerant tube of the plurality of refrigerant tubes, and wherein the one lower body is connected to an upper end of another refrigerant tube of the plurality of refrigerant tubes.

10. The heat exchanger of claim 8, wherein a portion of the one upper body does not overlap the one lower body in a vertical direction.

11. The heat exchanger of claim 1, wherein the fin overlaps the plurality of refrigerant tubes in the first direction.

12. The heat exchanger of claim 1, wherein the fin further comprises a body opening portion passing through at least a portion of the one lower body disposed in the outer portion.

13. The heat exchanger of claim 1, wherein the fin further comprises a drain groove located in the plurality of first bodies and the plurality of second bodies, and wherein the drain groove is disposed in the outer portion to prevent inflow of water from an outside.

14. The heat exchanger of claim 13, wherein the plurality of refrigerant tubes overlap each other in a vertical direction, and wherein the drain groove is open downward.

15. The heat exchanger of claim 13, wherein the fin further comprises an inflow prevention hole located in the plurality of first bodies and the plurality of second bodies, and wherein the inflow prevention hole is disposed in the outer portion to prevent the inflow of water from the outside.

16. The heat exchanger of claim 15, wherein the inflow prevention hole is disposed above the drain groove.

17. The heat exchanger of claim 13, wherein the drain groove comprises:

a first inclined surface inclined in the first direction; and a second inclined surface inclined in the first direction and connected to one end of the first inclined surface.

18. A heat exchanger comprising:

a plurality of refrigerant tubes configured to allow a refrigerant to flow therethrough; and a fin disposed between adjacent refrigerant tubes, the fin being configured to transfer heat, wherein the fin comprises:

a plurality of first bodies;

a plurality of second bodies, each second body being arranged between adjacent first bodies;

a plurality of upper bodies, each upper body connecting an upper end of a first body of the plurality of first bodies and an upper end of a second body of the plurality of second bodies that are adjacent to each other;

a plurality of lower bodies, each lower body connecting a lower end of a first body of the plurality of first bodies and a lower end of a second body of the plurality of second bodies that are adjacent to each other;

an inner portion overlapping the plurality of refrigerant tubes in a first direction; and an outer portion not overlapping the plurality of refrigerant tubes in the first direction, and wherein a distance between the lower end of a first body of the plurality of first bodies and the lower end of a second body of the plurality of second bodies that are connected to both ends of one lower body of the plurality of lower bodies is larger than a distance between the upper end of the first body and the upper end of the second body connected to the both ends of the one lower.

* * * * *